US005930906A

United States Patent [19]

Howe et al.

[11] Patent Number: 5,930,906

[45] Date of Patent: Aug. 3, 1999

[54] GUN SIGHT SYSTEM

[75] Inventors: Phillip D. Howe, Ft. Collins; Phillip Sutorius, Longmont; Robert Simon, Loveland, all of Colo.

[73] Assignee: North Pass, Ltd., Longmont, Colo.

[21] Appl. No.: 08/790,334

[22] Filed: Jan. 28, 1997

[51] Int. Cl.[6] ..... F41G 1/32; F41G 1/02

[52] U.S. Cl. ..... 33/241; 42/100

[58] Field of Search ..... 33/241, 265; 42/100, 42/103

[56] References Cited

U.S. PATENT DOCUMENTS

| | | | |
|---|---|---|---|
| Re. 24,313 | 5/1957 | Munsey | 33/241 |
| 154,871 | 9/1874 | Johnson | 33/241 |
| 2,430,469 | 11/1947 | Karnes | 33/241 |
| 2,471,027 | 5/1949 | Evans | 33/241 |
| 2,488,836 | 11/1949 | Sweetman | 33/241 |
| 3,500,545 | 3/1970 | Chivers | 33/241 |
| 4,161,835 | 7/1979 | Lough | 42/103 |
| 4,533,980 | 8/1985 | Hayes | 42/103 |
| 4,859,058 | 8/1989 | Ekstrand | 33/241 |
| 5,201,124 | 4/1993 | Sherman | 33/265 |
| 5,471,777 | 12/1995 | McDonald | 42/103 |
| 5,560,113 | 10/1996 | Simo et al. | 33/265 |
| 5,638,604 | 6/1997 | Lorocco | 33/241 |

FOREIGN PATENT DOCUMENTS

| | | | |
|---|---|---|---|
| 4214997-A1 | 11/1993 | Germany | 33/241 |
| 104905 | 3/1917 | United Kingdom | 33/241 |

*Primary Examiner*—Charles T. Jordan
*Assistant Examiner*—Denise J. Buckley
*Attorney, Agent, or Firm*—Dean P. Edmundson

[57] ABSTRACT

A high visibility gun sight system is described for mounting on a gun barrel (e.g., a muzzle-loading rifle). The system includes a base member for mounting to a gun barrel, and an elongated light-gathering plastic rod which is detachably mounted to the base member. Preferably the base member includes upwardly extending hoop members for engaging the plastic rod. The plastic rod can be detached, when desired, and replaced with a rod of a different color, for example.

6 Claims, 6 Drawing Sheets

GUN SIGHT SYSTEM

FIELD OF THE INVENTION

This invention relates to gun sight systems. More particularly, this invention relates to high-visibility gun sights for use on guns such as muzzle loaders.

BACKGROUND OF THE INVENTION

Guns such as muzzle loader rifles typically include a raised bead on a raised sight on the outer or distal end of the barrel to be used for determining a proper line of sight when aiming the gun at a desired target. In low-light conditions, however, it can be difficult to view the bead on the outer end of the barrel.

There has not heretofore been provided a gun sight system having the features and advantages provided by the present invention.

SUMMARY OF THE PRESENT INVENTION

In accordance with the present invention there is provided a high-visibility gun sight system for mounting on a gun barrel. In one embodiment the gun sight system comprises:

(a) a base member including mounting means for mounting of the base member to the gun barrel; and (b) elongated, light-gathering means detachably mounted to the base member.

The base member is adapted to be semi-permanently mounted on the top of the gun barrel. The light-gathering means is preferably a length of solid cylindrical colored plastic which is light-transparent. The exterior surface of the plastic is very smooth or polished. The rearward or viewing end may be slightly enlarged, if desired, and has a matte surface. The light-gathering means gathers light and produces a highly-visible bead of light at the viewing end of the device.

Preferably the base member includes a dove-tail or other suitable fastening means for mounting to a gun barrel. The base member holds and supports the light-gathering means on top of the barrel so that the elongated light-gathering means will be properly aligned with the longitudinal axis of the gun barrel.

Preferably the light-gathering means is detachable from the base member. This enables a new or different light-gathering means to be installed on the base member whenever desired.

Other advantages and features of the gun sight system of this invention will be apparent from the following detailed description and the accompanying drawings.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
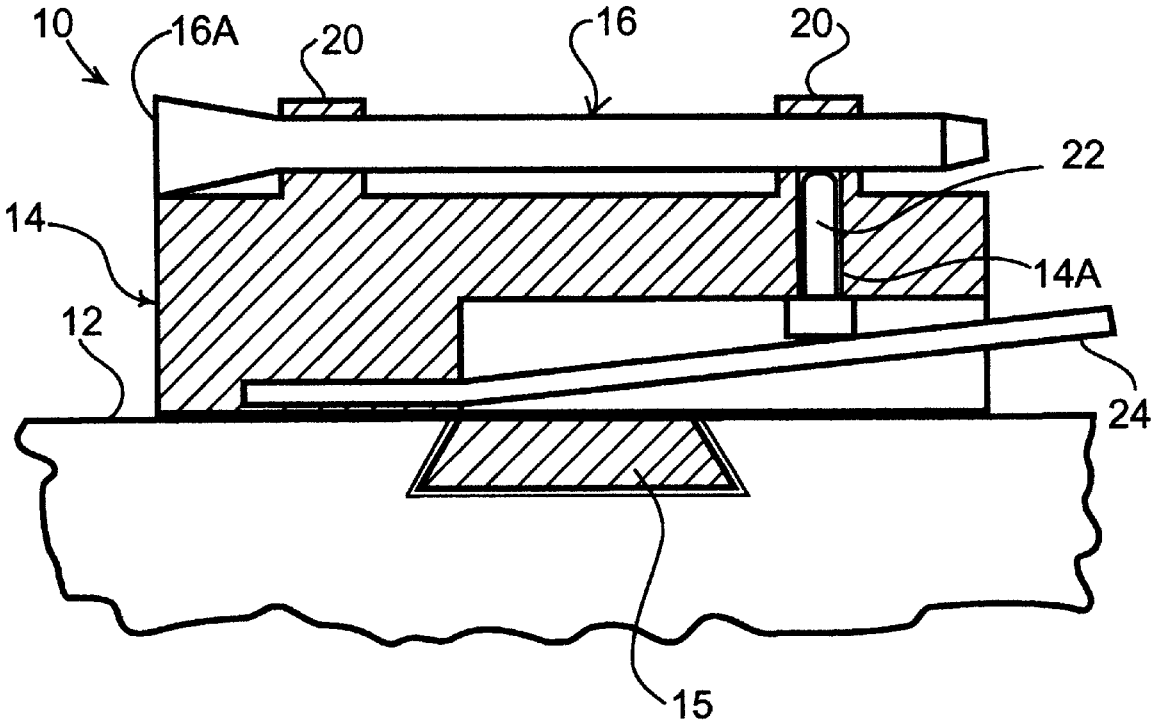
FIG. 1 is a side elevational, partially cut-away view of a preferred embodiment of a gun sight system of the invention.
Figure 2:
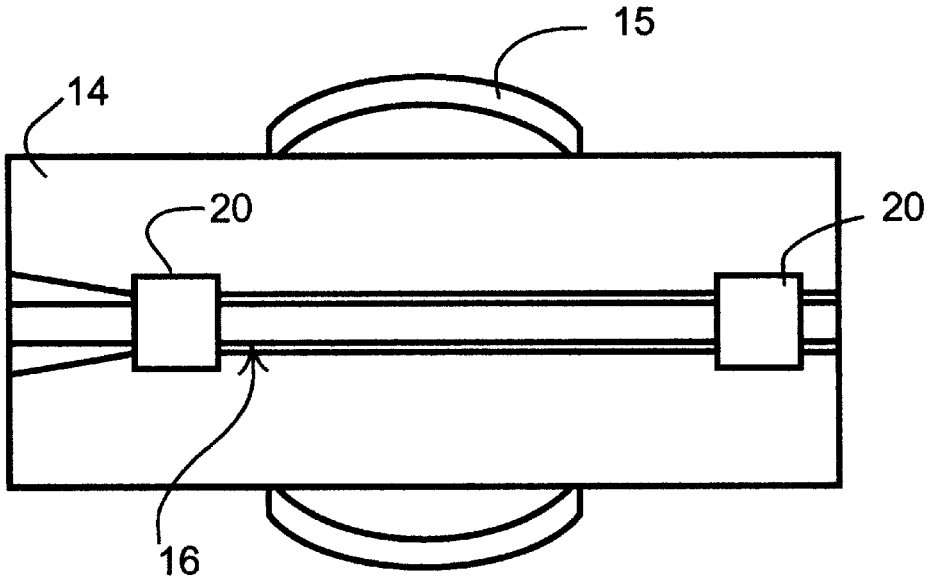
FIG. 2 is a top view of the gun sight system shown in FIG. 6.
Figure 3:
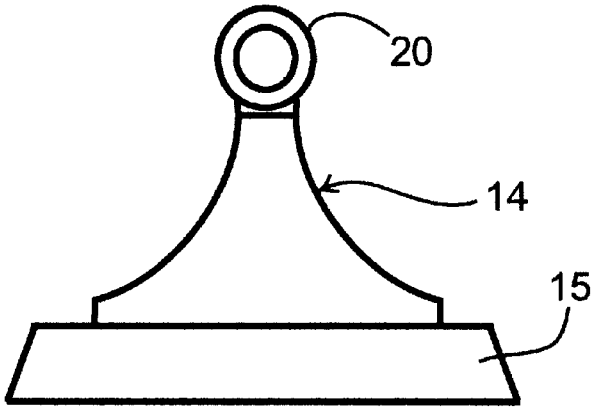
FIG. 3 is a rear elevational view of the gun sight system shown in FIG. 1.

In FIGS. 1–3 there is shown a preferred embodiment of gun sight system 10 of the invention for use on a gun barrel

12 (e.g., a muzzle loader rifle). This embodiment of gun sight system includes a base member 14 and an elongated light-gathering tube or rod means 16 which is detachably mounted on the upper surface of the base member.

The lower surface of the base member includes a dovetail mounting member 15 for securing the base to the upper surface of the gun barrel in a complementary shaped key way in the barrel.

The light-gathering means 16 preferably comprises a length of solid cylindrical colored plastic rod which is light-transparent. Preferably the exterior surface of the plastic rod is very smooth or polished. The forward end of the plastic rod is preferably slightly tapered. The rearward or viewing end 16A of the plastic rod preferably has a planar surface which is a matte or slightly roughened surface.

The length of the plastic rod 16 may vary but is generally in the range of about 0.25 to 1.5 inches. The diameter may also vary, but it is generally in the range of about 0.03 to 0.125 inch.

The plastic rod can be formed from a variety of well-known plastics such as acrylic, nylon, polycarbonate, polystyrene, etc. in which a soluble colored dye is included. Generally speaking, any self-supporting light-transparent plastic may be used for this purpose.

If desired, the rearward or viewing end 16A of the plastic rod can be enlarged as shown in the drawings. However, it is not necessary for the viewing end to be enlarged in this manner.

The elongated plastic rod can be detachably secured to the upper surface of the base member in a number of different ways. A simple and effective manner, as best shown in FIG. 1, involves the use of hoops or stirrups 20 extending upwardly from the upper surface of the base member. The hoops snugly or closely engage the exterior surface of the plastic rod at two spaced-apart points along the length of the plastic rod. The hoops are positioned such that they hold and support the plastic rod in a plane parallel to the longitudinal axis of the gun barrel and in proper alignment with the longitudinal axis of the barrel.

One manner of securing the plastic rod 16 in the hoops 20 involves the use of a vertical pin member 22 which is biased upwardly in an opening or bore 14A in base 14 by means of a spring member 24 or other suitable bias means. The upper end of the pin 22 presses against the rod 16 in one of the hoops 20 to thereby secure the rod within the hoop. In order to release the rod 16, the outer end of spring 24 is pressed downwardly, whereby the pin 22 can move downwardly away from the rod 16. This procedure enables one rod member 16 to be removed and another rod member to be inserted in its place.

Because the plastic rod is detachable from the base member, it is very easy to install a new plastic rod whenever that is necessary or desirable. For example, differently colored plastic rods can be used for differing light conditions.

Figure 4:
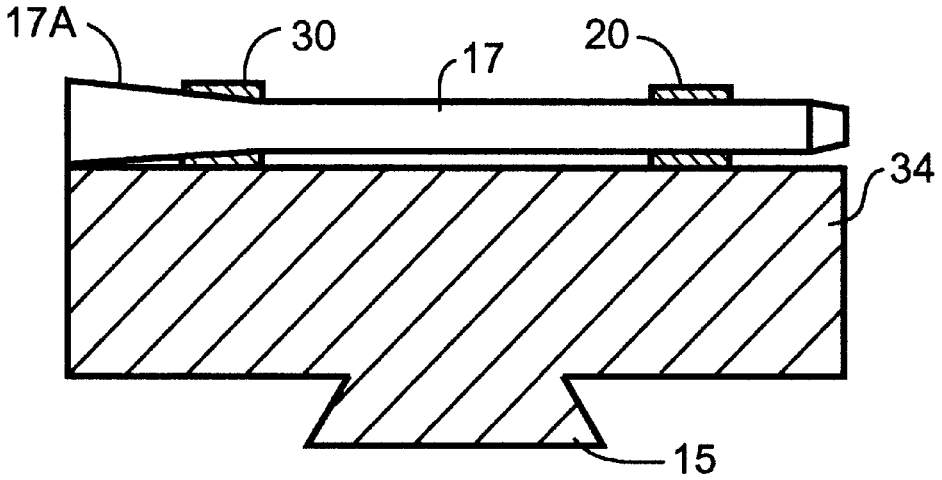
FIGS. 4–14A illustrate other embodiments of gun sight systems of this invention.

Other embodiments of the gun sight system are illustrated in the remaining drawings. In FIG. 4 the rearward hoop 30 has a slightly tapered base so as to accommodate the large tapered end 17A of rod 17. The frictional engagement of the rod in hoop 30 tends to retain the rod in place on base member 34.

Figure 5:
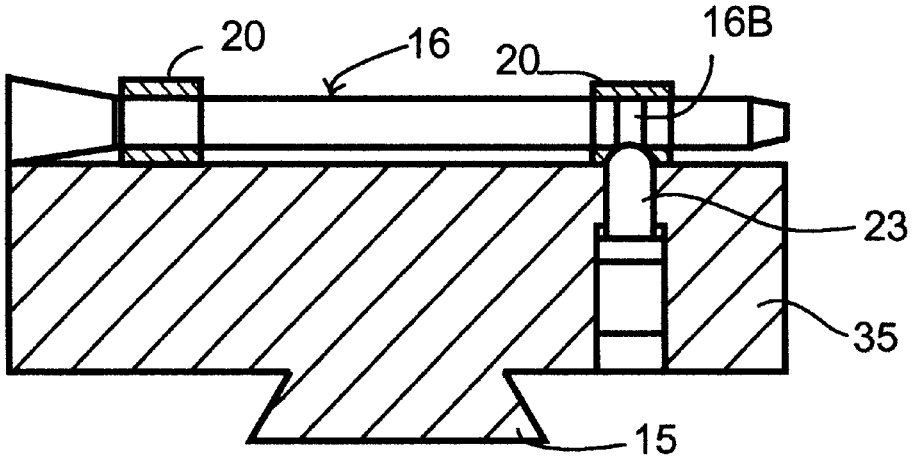

In FIG. 5 the base member 35 includes a spring-biased plunger 23 and the plastic rod 16 includes an annular groove 16B into which the tip of the plunger 23 is received when the rod 16 is inserted into the hoops 20, as shown and illustrated.

Figure 6:
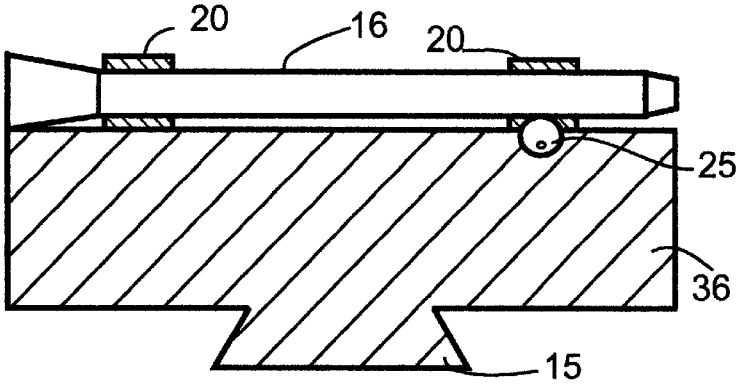

In FIG. 6 a ball 25 is seated in base means 36 in a position such that the upper surface of the ball urges against the underside of the rod 16 when the rod is inserted into the hoops.

Figure 7:
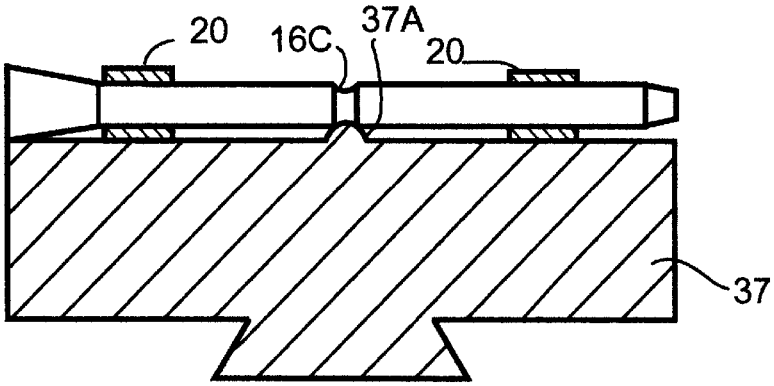

In FIG. 7 the base means 37 includes an upwardly projecting button 37A on its upper surface. Correspondingly, the rod 16 includes an annular groove 16C which engages the button 37A when the rod is inserted into the hoops.

Figure 8A:
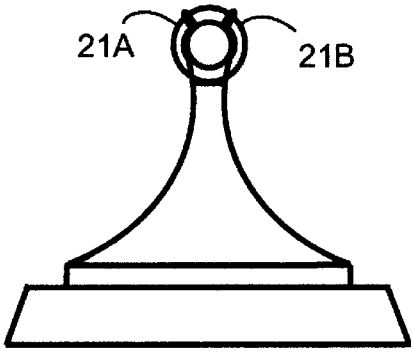
Figure 8:
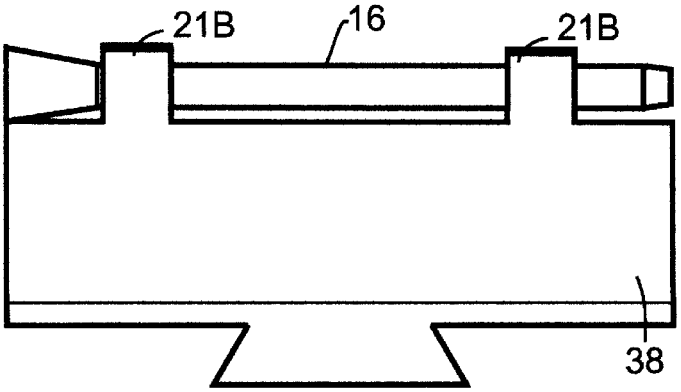

FIGS. 8 and 8A illustrate another embodiment in which the plastic rod 16 is held between opposing resilient curved fingers 21A and 21B. This arrangement enables the rod 16 to be simply snapped into place on base means 38.

Figure 9:
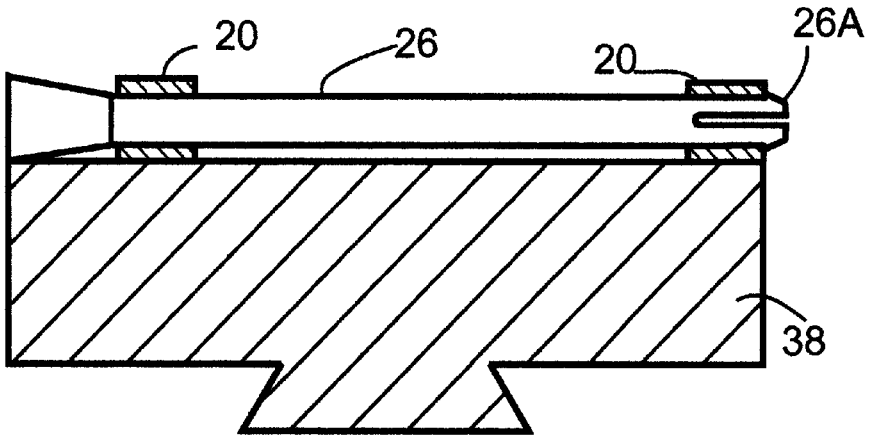

FIG. 9 illustrates an embodiment in which the forward end 26A of plastic rod 26 is split and which is also barbed so that when the rod 26 is fully inserted into the hoops, the barbed end 26A engages the forward edge of the hoop and prevents the rod 26 from sliding rearwardly.

Figure 10:
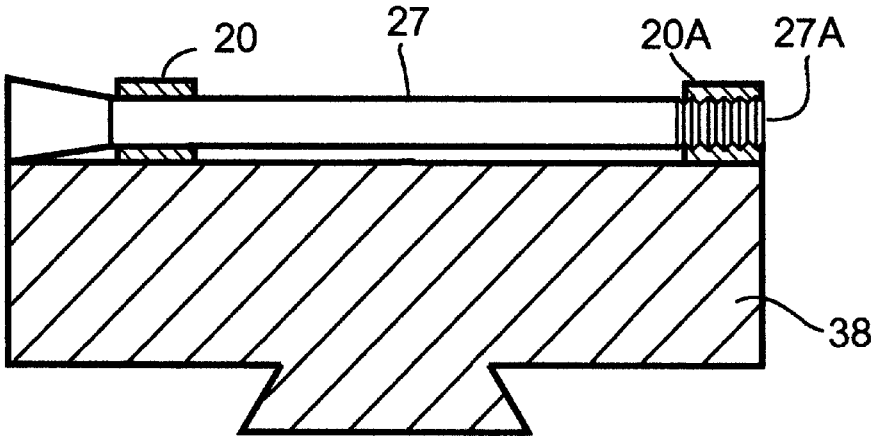

FIG. 10 illustrates another embodiment in which the forward end 27A of plastic rod 27 is threaded so that it can be received in the threaded hoop 20A, as shown.

Figure 11:
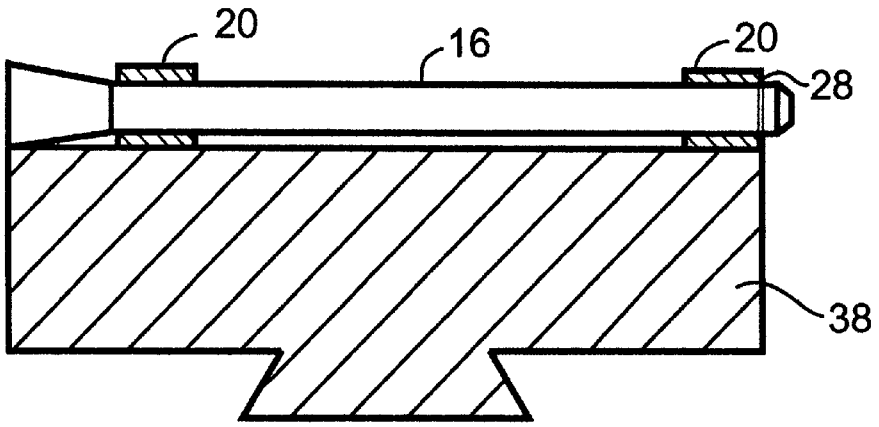

In FIG. 11 there is shown yet another embodiment in which the forward end of plastic rod 16 is secured by means of a snap ring 28 which engages the rod 16 forwardly of a hoop 20. After the snap ring is removed, the plastic rod 16 can be detached from the hoops 20.

Figure 12:
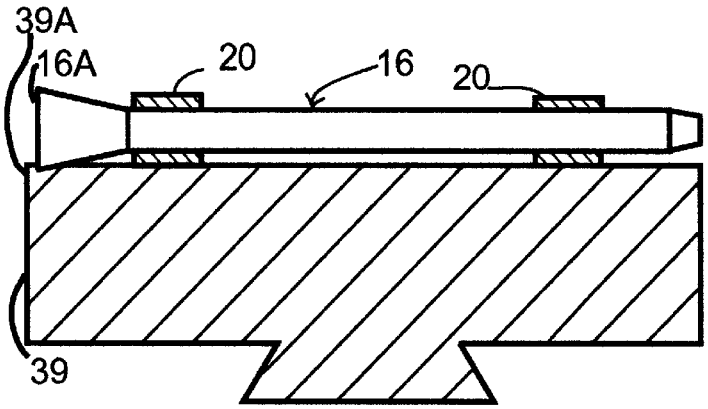

In FIG. 12 the base means 39 includes an upwardly projecting lip 39A. When the plastic rod 16 is inserted into the hoops 20, the enlarged rearward end 16A of rod 16 slides past the lip 39A and is thereby retained in place, as shown.

Figure 13A:
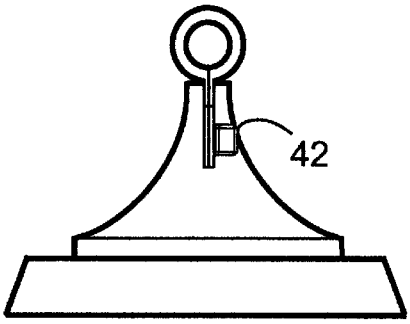
Figure 13:
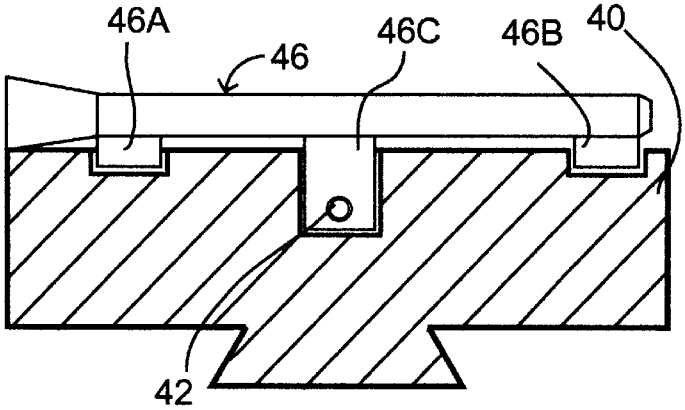

FIGS. 13 and 13A illustrate another embodiment in which the plastic rod 46 includes downwardly projecting tab members 46A, 46B and 46C, which are received in appropriate recesses in base means 40. A screw of fastener 42 secures tab 46C to the base means, as shown.

Figure 14:
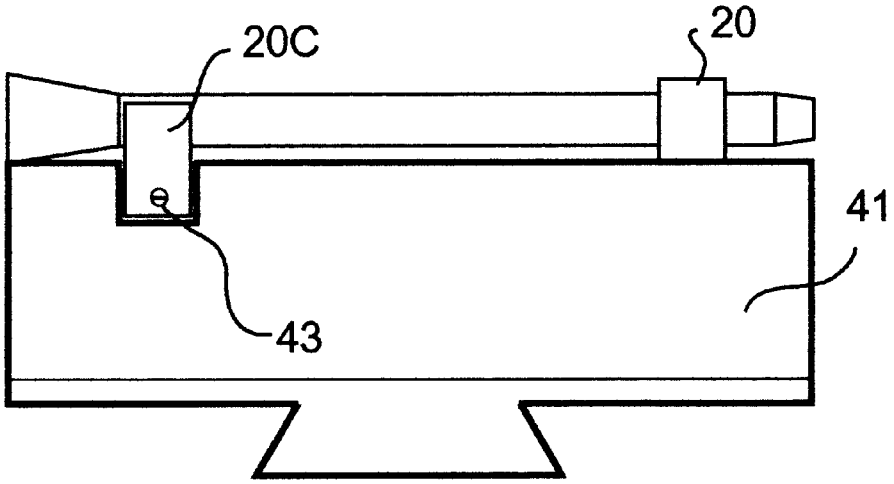
Figure 14A:
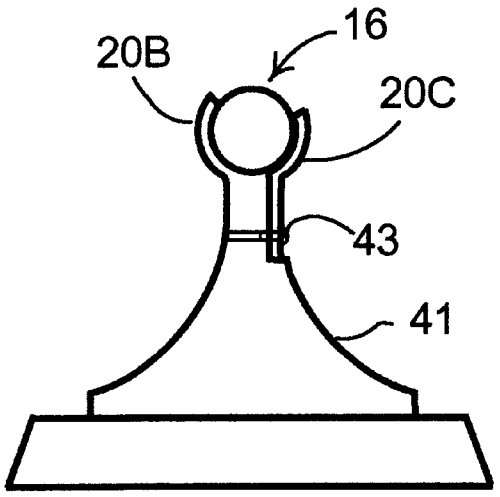

FIGS. 14 and 14A illustrate another embodiment in which the forward end of plastic rod 16 is held in a hoop 20, and the rearward end of rod 16 is secured between finger 20B and a removable finger 20C which secured to the base 41 by means of a screw 43.

Other variants are possible without departing from the scope of this invention. It is also possible to use the gun sight system of this invention on other types of rifles and pistols.

What is claimed is:

1. A high-visibility gun sight system for mounting on a gun barrel, said system comprising:

(a) a base nember including mounting means for mounting of said base member to said gun barrel; wherein said base member has forward and rearward ends and an upper surface; wherein said upper surface of said base member include upwardly extending hoop members;

(b) elongated, light-gathering tube means detachably mounted to said upper surface of said base member by means of said hoop members; and (c) locking means for securing said tube means to said base member; wherein said locking mean comprises (i) a pin member which is movable in said base member between raised and lowered positions; and (ii) bias means for biasing said pin member toward said raised position; wherein said pin member is urged against said tube means when said pin member is in said raised position.

2. A system in accordance with claim 1, wherein said light-gathering tube means includes a smooth surface, a tapered end, and an enlarged end.

3. A system in accordance with claim 2, wherein said enlarged end comprises a viewing end having a matte surface.

4. A system in accordance with claim 2, wherein said tube means comprises a length of solid cylindrical colored plastic which is light-transparent.

5. A system in accordance with claim 4, wherein said tube means has a length in the range of about 0.5 to 1.5 inches and a diameter in the range of about 0.030 to 0.15 inch.

6. A system in accordance with claim 1, wherein said locking means comprises a spring-loaded plunger carried by said base member, wherein said plunger urges against said tube means.

* * * * *